US005105598A

United States Patent [19]

Wilcox

[11] Patent Number: 5,105,598

[45] Date of Patent: Apr. 21, 1992

[54] ADJUSTABLE METAL BRACE

[76] Inventor: Robert Wilcox, 1271 Driftwood Ave., Clearwater, Fla. 33546

[21] Appl. No.: 693,208

[22] Filed: Apr. 30, 1991

[51] Int. Cl.[5] ..... E04C 3/30

[52] U.S. Cl. ..... 52/721; 52/693; 52/696

[58] Field of Search ..... 52/721, 695, 696, 726, 52/693, 694, 697, 118

[56] References Cited

U.S. PATENT DOCUMENTS

| | | | |
|---|---|---|---|
| 752,655 | 2/1904 | Cook | 52/697 |
| 1,773,357 | 8/1930 | Griswold | 52/695 |
| 3,367,080 | 2/1968 | McClelland | 52/695 X |

FOREIGN PATENT DOCUMENTS

| | | | |
|---|---|---|---|
| 510212 | 9/1920 | France | 52/695 |

OTHER PUBLICATIONS

Simpson Strong-Tie ® Connectors, product brochure.

Unistrut All Purpose Framing, Sweets catalog ©1978, pp. 2458-18 through 2458-36.

*Primary Examiner*—Richard E. Chilcot, Jr.

*Attorney, Agent, or Firm*—Joseph C. Mason, Jr.; Ronald E. Smith

[57] ABSTRACT

A brace member that braces structural members against movement in an environment where a pair of structural members are joined together and orthogonally disposed with respect to one another. The brace member has two parts that are telescopically coupled together and which are selectively lockable in a plurality of positions of longitudinal and rotational adjustment. Each part includes a tubular section and a flattened section which are bendable relative to one another along a folding line. The flattened ends of the brace members overlie and are fastened to any preselected surface of a structural member to be braced. The tubular parts are lockable to one another in two positions of rotational adjustment that are disposed circumferentially ninety degrees from one another so that the flattened parts may selectively overlie preselected surfaces of said structural members that are coplanar or disposed at right angles to one another.

3 Claims, 1 Drawing Sheet

ADJUSTABLE METAL BRACE

TECHNICAL FIELD

This invention relates, generally, to braces of the type used in building construction. More particularly, it primarily relates to braces for wooden structural members that are disposed at ninety degree angles or thereabout relative to one another.

BACKGROUND ART

U.S. Pat. No. 3,367,080 to McClelland discloses an adjustable cross brace having utility in connection with the bracing of structural members that are disposed in parallel relation to one another.

Another brace having utility in connection with the bracing of parallel structural members is disclosed in U.S. Pat. No. 1,773,357 to Griswold.

Accordingly, means for bracing parallel structural members are known. However, the art of bracing perpendicular structural members is less well developed. For example, a tubular knee brace is shown in a Unistrut Product Brochure at page 50 thereof under the heading "Special Application Fittings." However, that brace is not adjustable and it has utility in only one particular arrangement of perpendicularly disposed structural members.

Accordingly, there is a need for an adjustable brace member for rigidly bracing orthogonally disposed structural members, but the prior art, taken as a whole, neither teaches nor suggests how such a brace could be provided.

DISCLOSURE OF INVENTION

The present brace means includes a first linear-in-configuration part of metallic construction having a first tubular part and a first flattened part and a second linear-in-configuration part having a second tubular part and a second flattened part. The inner diameter of the first tubular part is slightly greater than the outer diameter of the second tubular part, so that the first tubular part telescopically receives the second tubular part therein.

Four equidistantly and circumferentially spaced bore means are formed in the first tubular part of the brace means near its open end and are therefore spaced ninety degrees from one another, i.e., two pairs of axially aligned or diametrically opposed aperture members are formed in said open end so that a single pin member may selectively extend through said first pair or said second pair of apertures. Since the first pair of apertures and the second pair of apertures are circumferentially spaced apart from one another by ninety degrees, a pin extending between diametrically opposite pairs of said first pair of apertures would intersect a pin extending between diametrically opposite pairs of said second pair of apertures. Since only one pin is ever employed at a time, such an intersection of pins would never occur; this illustration is given just to better explain what is meant when it is said that the first and second pairs of apertures formed in said first tubular part are circumferentially spaced ninety degrees from one another.

A plurality of diametrically opposed, longitudinally aligned and longitudinally spaced apart bore means are formed in the open end of the second tubular part of the brace means.

Thus, the telescoping members can be secured to one another in two different ways. In the first attachment, a pin extends through a first preselected pair of diametrically opposed bore means formed in the first or outer tubular part and through a preselected pair of diametrically opposed bore means formed in the second tubular part. In the second attachment, a pin extends through a second preselected pair of diametrically opposed bore means formed in the first tubular part and through a preselected pair of diametrically opposed bore means formed in the second or inner tubular part.

Thus, in the first attachment configuration, the flattened ends of each brace part are disposed in coplanar relation to one another and in the second attachment configuration, said flattened ends are disposed in orthogonal relation to one another. In either configuration, the length of the brace is determined by the selection of bore means formed in the second tubular part.

A transversely disposed folding line separates each tubular part and its associated flattened part. Thus, each flattened part may be bent at various angles relative to its tubular part to facilitate use of the novel brace member in a wide variety of applications. Due to the metallic construction of the parts of the brace member, the brace member can be re-used. Moreover, the flattened parts will remain in their respective bent positions once bent, until bent again when re-used in a different environment.

Thus, the invention is new, useful and was not obvious to those of ordinary skill in the art at the time it was made.

It is therefore understood that a primary object of this invention is to advance the art of brace members of the type used when bracing structural members that are disposed at ninety degree angles or thereabout to one another.

A related object is to provide such a brace member that is longitudinally adjustable to thereby increase its versatility.

Another object is to provide a brace member having flattened ends that are bendable relative to a longitudinal axis of the brace member to further increase the versatility of the brace member.

Still another object is to provide a brace member having two telescopically interconnected parts that may be locked into two different rotational positions of adjustment that are ninety degrees from one another so that the flattened ends of each part of the brace member may be coplanar or disposed in orthogonal relation to one another as required by the environment in which the brace member is used.

Other advantages and objects of the present invention will become apparent as this description proceeds.

The invention accordingly comprises the features of construction, combination of elements and arrangement of parts that will be exemplified in the construction set forth hereinafter and the scope of the invention will be indicated in the Claims.

DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

BEST MODES FOR CARRYING OUT THE INVENTION

Figure 1:
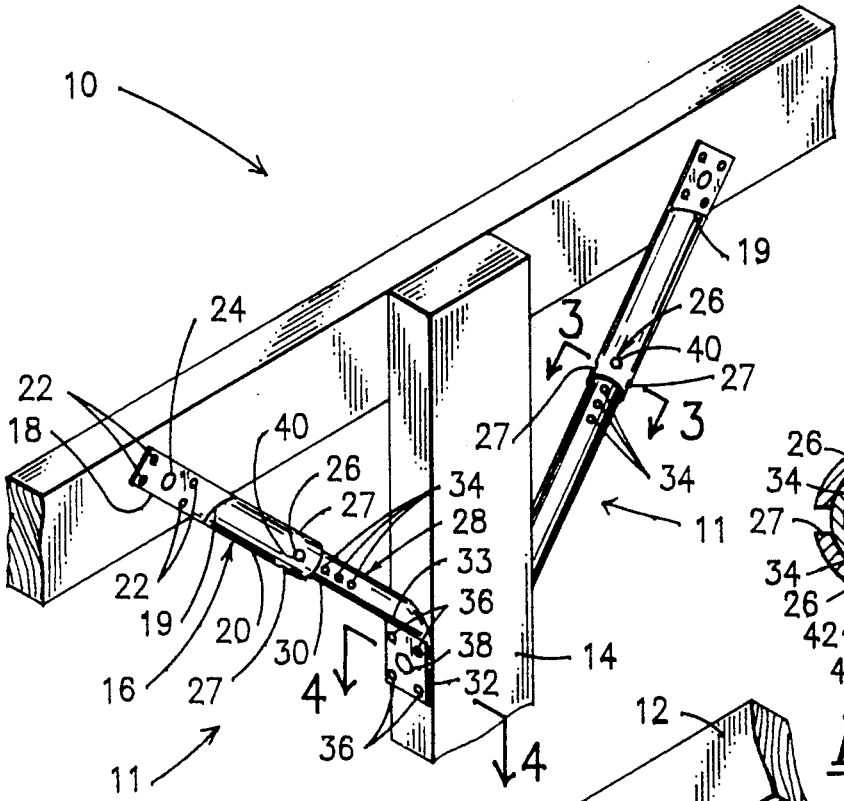
FIG. 1 is a perspective view of a first environment where the novel brace member has utility.

A first environment where the novel brace member may be used is shown in FIG. 1 and is denoted by the reference numeral 10 as a whole.

In this particular environment, a first structural member 12 and a second structural member 14 are secured to one another by suitable means, not shown, in substantially orthogonal relation to one another. Member 12, as shown, lies in a different vertical plane than member 14.

Figure 4:
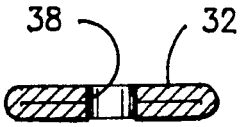
FIG. 4 is a transverse sectional view taken along line 4—4 in FIG. 1.

The first or outer part of the novel brace member 11 is denoted 16 as a whole, is sometimes hereinafter referred to as the sleeve member, and includes flattened end 18 and tubular end 20. The flattened end 18 is formed by flattening the end of the brace, as is clear from FIG. 4. A plurality of preferably four aperture members, collectively denoted 22, are formed in respective corners of flattened end 18; a fifth aperture means 24 is formed centrally thereof. These four aperture members can be used to fasten flattened part 18 to any preselected surface of a structural member with nails, rivets or other suitable fastening means. Moreover, central aperture 24 receives lag screws or bolts and nuts, or other suitable fastening means. Thus, the flattened ends of the novel brace member can be fixedly secured to a preselected surface of a structural member by a first type of fastening means, a second type of fastening means or a combination of fastening means. Importantly, the fastening means can be removed so that brace member 11 can be re-used.

A first bore means 26, 26 is formed near the open end of tubular part 20, it being understood that said first bore means is defined by a pair of diametrically opposed aperture members. A second bore means 27, 27 is also formed near the open end of part 20, said second bore means also being formed of a pair of diametrically opposed aperture members. Thus, there are four aperture members formed near the open end of part 20, in equidistant and circumferentially spaced relation to one another, i.e., the four apertures 26, 26 and 27, 27 are spaced at ninety degree intervals about part 20 as perhaps best shown in FIG. 3. It should therefore be understood that the first and second bore means are disposed in intersecting relation to one another.

The second or inner part of the novel brace member 11 is denoted 28 as a whole, is sometimes hereinafter referred to as the telescopic member, and includes a tubular part 30 and a flattened part 32; tubular part 30 is telescopically received within tubular part 20 of the first part 16 of the brace member 11 as shown.

A plurality of longitudinally aligned and longitudinally spaced apart bore means, collectively denoted 34, are formed in the tubular part 30 as shown. Each bore means 34 is formed by a pair of diametrically opposed aperture members formed in said tubular part 30.

Flattened part 32 is also provided with four aperture members 36 formed in its corners and a central aperture member 38 to accommodate fastening means as described in connection with flattened part 18.

It will be noted on the left side of FIG. 1 that in environment 10, flat parts 18 and 32 are disposed in planes that are orthogonal to one another. It will also be observed that a transversely disposed folding line 19 separates flat part 18 and its associated tubular part 20 and that a transverse folding line 33 separates flattened part 32 and its associated tubular part 30.

Figure 3:
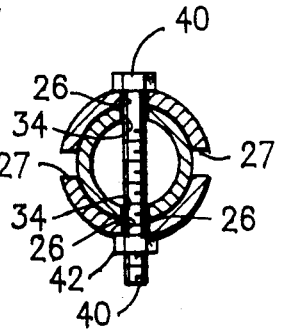
FIG. 3 is a transverse sectional view taken along line 3—3 in FIG. 1.

On said left side of FIG. 1, flattened part 18 has not been substantially bent along folding line 19, but flat part 32 has been bent at about a forty-five degree angle along folding line 33, as shown. When so disposed, pin member 40 interconnects bore means 26, 26 formed in tubular part 20 of sleeve member 16 and a preselected one of the bore means in the plurality of bore means 34 formed in tubular part 30 of telescopic member 28 and thereby locks the two telescoping parts 16, 28 together. As shown in FIG. 3, pin 40 may take the form of a bolt 40 that is secured against retraction by nut 42.

Tubular part 20 is also provided with a second bore means 27, 27 as mentioned earlier, that is circumferentially spaced from the first bore means 26, 26 ninety degrees therefrom.

Figure 2:
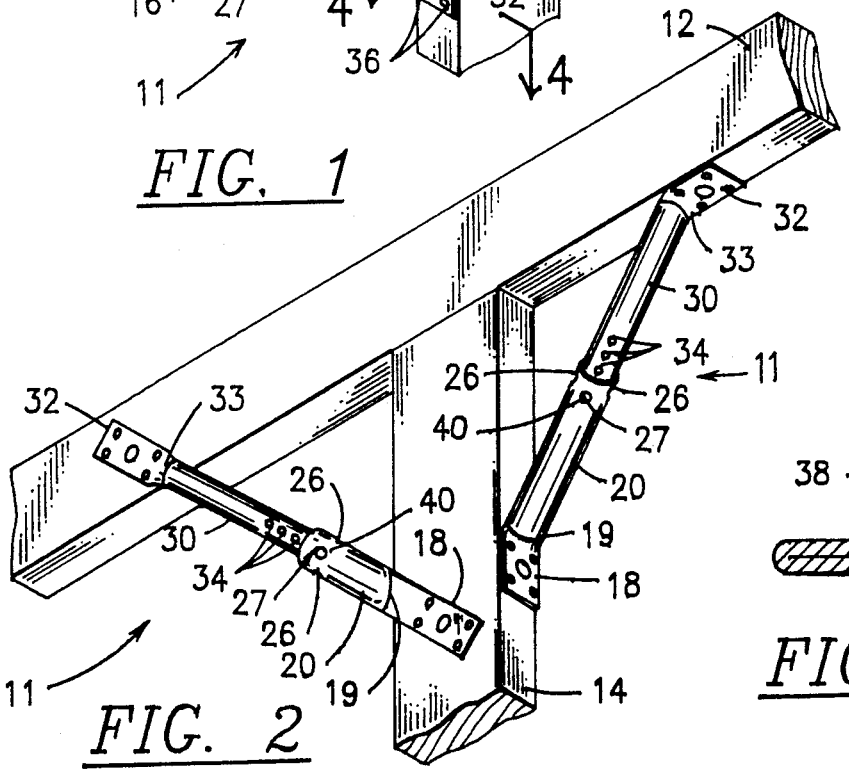
FIG. 2 is a perspective view of a second environment where the novel brace member has utility.

The second bore means 27, 27 is also shown in FIG. 2. In the environment of FIG. 2, flattened parts 18, 32 are disposed in a common plane, i.e., they are rotated ninety degrees from the FIG. 1 position. Thus, by comparing FIGS. 1 and 2, it should be clear that the first and second parts of the novel brace means are selectively lockable together in a first position of rotational adjustment and in a second position of rotational adjustment, said first position of rotational adjustment being established when said pin member 40 extends through said first bore means 26, 26 formed in tubular part 20 of said first part or sleeve member 16 of said brace means and through a preselected bore means of said plurality of bore means 34 formed in said tubular part 30 of said second part or telescopic member 28 of said brace means, and said second position of rotational adjustment being established when said pin member 40 extends through said second bore means 27, 27 formed in said tubular part 20 of said first part 16 of said brace means and through a preselected bore of said plurality of bore means 34 formed in said tubular part 30 of said second part 28 of said brace means.

The flattened parts 18, 32 are substantially unbent on the left-hand side of FIG. 2, since brace 11 is being employed to brace two coplanar surfaces as depicted.

A third configuration of the brace member 11 is shown on the right-hand side of FIG. 2. In this configuration, pin 40 extends through bore means 27, 27 and a preselected pair of diametrically opposed apertures of the bore means 34 formed in inner tube part 30, just as in the left-hand side of FIG. 2 but different from the configuration of FIG. 1 where the inner and outer tubes are rotated ninety degrees, as aforesaid.

As in the embodiment of FIG. 1, the flattened ends 18, 32 in the third configuration are bent about forty-five degrees relative to the longitudinal axis of the tubular parts 20 and 30. It should be clear, however, in all applications, that the angle of bending will vary depending upon the placement of the flattened parts 18, 32 along the extent of their respective preselected surfaces of structural members 12, 14. For example, as is clear from the right side of FIG. 2, positioning flat part 32 closer to structural member 14 will make the angle between said flat part 32 and tubular part 30 more acute and the angle between flat part 18 and tubular part 20 more obtuse. Such positioning of flat part 18 will also require the shortening of brace 11, i.e., pin 40 will need to be inserted into another preselected bore means 34.

Thus, there are essentially three degrees of freedom in brace member 11. Its length is adjustable, its telescoping parts can be rotated ninety degrees relative to one another, and its flattened ends can assume virtually any angle relative to the longitudinal axis of the brace member 11. This enables brace 11 to interconnect structural members that are disposed at ninety degrees or about ninety degrees, more or less, from one another in differing configurations such as shown in FIGS. 1 and 2. Most importantly, the three degrees of freedom make the device 11 highly versatile so that it can be used in a multitude of environments where the braces of the prior art have little or no utility.

In an alternative embodiment, not expressly shown but easily within the scope of this invention, a single bore means is formed in part 20, and a second plurality of bore means, circumferentially spaced ninety degrees from the first plurality 34, are formed in part 30. This second embodiment thus operates in exactly the same way as the embodiment that has been shown and described, but the first embodiment is preferred because it is believed that a second set of longitudinally spaced, diametrically opposed apertures formed in part 30 could adversely affect its structural integrity.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A brace means for bracing structural members that are interconnected and substantially orthogonally disposed to one another, comprising:

said brace means having a first part and a second part;

said first part of said brace means being a sleeve member of linear configuration and said sleeve member having a tubular part of a first predetermined diameter and a flattened part;

said second part of said brace means being a telescopic member of linear configuration and said telescopic member having a tubular part of a second predetermined diameter and a flattened part;

said second predetermined diameter being less than said first predetermined diameter so that the tubular part of said sleeve member telescopically receives the tubular part of said telescopic member;

a first bore means, defined by a first pair of diametrically opposed aperture means, being formed in said tubular part of said sleeve member;

a second bore means, defined by a second pair of diametrically opposed aperture means, also being formed in said tubular part of said sleeve member;

said first and second bore means being circumferentially spaced ninety degrees apart from one another, there being four equidistantly and circumferentially spaced apertures formed in said tubular part of said sleeve member;

said first and second bore means being disposed in intersecting relation to one another;

a plurality of longitudinally aligned and longitudinally spaced apart bore means, each of said plurality of bore means being defined by a pair of diametrically opposed aperture means, and being formed in said tubular part of said telescopic member;

means for selectively locking together said sleeve and telescopic members, in a first position of rotational adjustment and in a second position of rotational adjustment, when the tubular part of said telescopic member is slidably received within the tubular part of said sleeve member;

said means for locking together said sleeve and telescopic members including a linear-in-configuration pin member having an extent greater than the diameter of said sleeve member and further including means for preventing retraction of said pin member when it is disposed in locking relation to said sleeve and telescopic members;

said first position of rotational adjustment being established when said pin member extends through said first bore means formed in said tubular part of said sleeve member and through a preselected bore means of said plurality of bore means formed in said tubular part of said telescopic member;

said second position of rotational adjustment being established when said pin member extends through said second bore means formed in said tubular part of said sleeve member and through a preselected bore means of said plurality of bore means formed in said tubular part of said telescopic member;

a first substantially transversely disposed folding line disposed between said tubular part and said flattened part of said sleeve member so that said flattened part is selectively positionable at differing angles of adjustment;

a second substantially transversely disposed folding line disposed between said tubular part and said flattened part of said telescopic member so that said flattened part is selectively positionable at differing angles of adjustment; and at least one aperture member formed in the respective flattened parts of said sleeve and telescopic members, each of said at least one aperture members being configured and dimensioned to receive a preselected fastening means so that said respective flattened parts are securable in overlying relation to preselected surfaces of said structural member;

whereby said sleeve and telescopic members are rotationally and telescopically adjustable with respect to one another.

2. The brace means of claim 1, wherein said plurality of aperture members includes a central aperture member formed in the center of each respective flattened part and a plurality of aperture members disposed in surrounding relation to said central aperture member.

3. The brace means of claim 2, wherein said first and second parts are of metallic construction, said flattened parts remaining in their preselected angular positions when bent and said brace means being reusable and said flattened parts being rebendable due to said metallic construction.

* * * * *